United States Patent [19]

Granbom

[11] Patent Number: 4,773,304

[45] Date of Patent: Sep. 27, 1988

[54] DEVICE AT PNEUMATIC CYLINDERS

[76] Inventor: Bo Granbom, 13 Lostigen, S-731 42 Köping, Sweden

[21] Appl. No.: 881,714

[22] Filed: Jul. 3, 1986

[51] Int. Cl.[4] ..... F01B 29/04; F01B 29/00; F01B 1/04

[52] U.S. Cl. ..... 92/59; 92/88; 92/128; 92/146; 92/169

[58] Field of Search ..... 92/59, 88, 128, 146, 92/161, 169, 61; 248/223.4, 224.1, 225.1; 417/529

[56] References Cited

U.S. PATENT DOCUMENTS

| | | | |
|---|---|---|---|
| Re. 23,763 | 1/1954 | Brown | 92/146 X |
| 1,963,487 | 6/1934 | Brown | 92/146 X |
| 2,200,427 | 5/1940 | Merz | 92/88 X |
| 2,721,718 | 10/1955 | Wagner | 248/223.4 X |
| 4,685,383 | 8/1987 | Ruchser | 92/88 |

FOREIGN PATENT DOCUMENTS

| | | | |
|---|---|---|---|
| 626968 | 2/1936 | Fed. Rep. of Germany | 92/146 |
| 2939422 | 9/1979 | Fed. Rep. of Germany . | |
| 350396 | 12/1971 | Sweden . | |

*Primary Examiner*—Robert E. Garrett
*Assistant Examiner*—Mark A. Williamson
*Attorney, Agent, or Firm*—Cushman, Darby & Cushman

[57] ABSTRACT

Device at such pneumatic cylinders where the piston is provided with a lateral carrier means (2) extending through a slot in the cylinder wall, said slot being sealed by means of a sealing band (3). On the outside of the cylinder (1) there is provided at least one undercut groove (4) extending along the cylinder and in parallel with its axis. A strip (6) corresponding to the length of the cylinder is further arranged to comprise at least two profiles (8) lying in a common plane, turned in opposite directions and having a cross-sectional form corresponding to that of the undercut groove (4).

3 Claims, 1 Drawing Sheet

DEVICE AT PNEUMATIC CYLINDERS

This invention relates to a device at such pneumatic cylinders, "Origa cylinders", where the piston is provided with a carrier means extending laterally through a slot in the cylinder wall and moving along the slot by the pneumatic pressure. This is sealed and seals against the interior of the cylinder by means of a sealing band.

Sometimes it is desired to interconnect several such cylinders beside each other, a greater force being obtained as compared with a simple cylinder. Alternatively, cylinders of a smaller diameter can be used for obtaining the same force. Due to the fact that the end fittings of the weaker cylinders provided with valves are shorter than those of the coarser cylinders a shorter built-in length is obtained at the same time when using several weaker cylinders than what should have been the case using a single corresponding coarser cylinder.

At parallel connection of several piston-cylinder devices beside each other there are great problems in mounting the cylinders exactly parallel and preventing each type of the drawer effect in the work of the cylinders.

It is possible by means of the present invention such as this is apparent from the characterizing portions of the claims to interconnect in a very simple and efficient way two or more "Origa cylinders", an exact parallelism between the cylinders being automatically obtained simultaneously as these are stiffened, which is very important using long cylinders.

Figure 2:
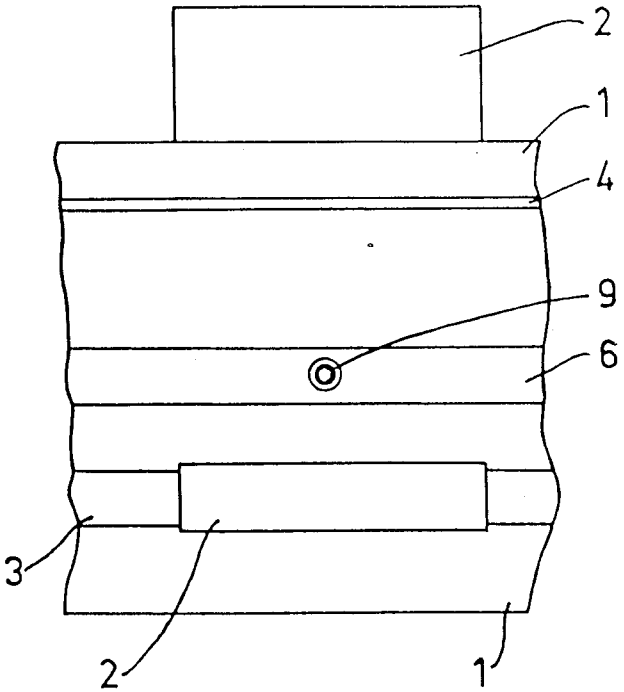
Figure 1:
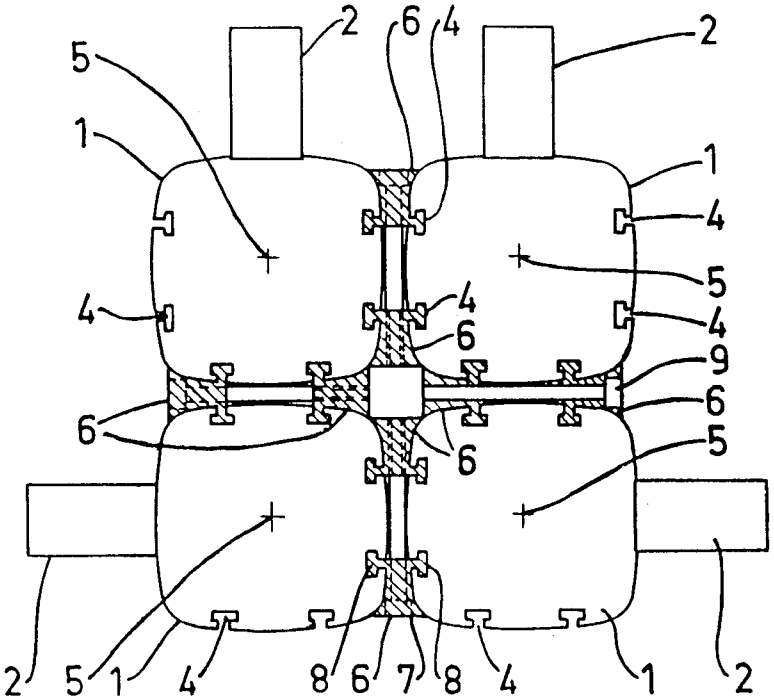

The invention will be described more closely in the form of an example with reference to the drawing, in which FIG. 1 shows schematically a section of four cylinders mounted in parallel and FIG. 2 shows schematically a partial lateral view of the interconnected cylinders.

1 designates each of the four cylinders which are shown in FIG. 1 only with their outer contours. 2 designates the carrier means attached to the respective piston (not shown), extending in known manner in a slot arranged along the cylinder, covering and sealing the interior of the cylinder by means of a band designated 3 in FIG. 2. This type of cylinder is known per se and is here no part of the invention.

In the example shown each cylinder is given a substantially square profile and has two undercut grooves 4 on three sides. These grooves are preferably manufactured at the same time as the cylinder and extend exactly in parallel with the center axis 5 thereof. The shape of the undercut groove 4 can of course vary and according to the example the grooves have a profile of a substantially rectangular form.

For the interconnection of the four cylinders shown in the example eight strips 6 are used which each have in profile a main portion 7, the opposite sides of which having a form connecting to the outside of the cylinder. The strip has further profiles 8 lying in a common plane, turned in opposite directions and having a cross-sectional form corresponding to that of the untercut groove 4. The strip 6 has a length corresponding to that of the cylinder 1. The strips 6 are fixed in pairs between two cylinders by means of screws 9, as shown in the figures.

Of course it is to be understood that an optional number of cylinders can be interconnected in this way. The interconnection can be made with the cylinders placed in an optional pattern which will be easily realized.

Within the scope of the invention it will be apparent to one skilled in the art that the cross-sectional forms of the cylinder, the undercut grooves 4, the strips 6 and the profiles 8 can be varied attaining the set aim.

What I claim is:

1. Device at such pneumatic cylinders where the piston is provided with a lateral carrier means extending through a slot in the cylinder wall, said slot being sealed by means of a sealing band, characterized in that there are two parallel cylinders each having a substantially square cross section and each having a side provided with two undercut grooves extending along the cylinder and in parallel with its axis and that a strip corresponding to the length of the cylinders is arranged in each groove, each strip comprising at least two profiles lying in a common plane, turned in opposite directions and having a cross-sectional form corresponding to that of the respective undercut groove, the strips being fixed to each other by means of screws acting between the two strips.

2. The device of claim 1, characterized in that three sides of the cylinder are each provided with two undercut grooves.

3. A piston and cylinder assembly comprising: at least two adjacent, separate side-by-side, parallel piston and cylinder units in each of which the piston is provided with a carrier projecting laterally through a slot in the cylinder wall, said slot being sealed by a sealing band, and the wall of each cylinder which faces the wall of the adjacent cylinder having two undercut grooves extending the entire length of the cylinder parallel to the axis of the cylinder; two connecting strips connecting the two cylinders together and maintaining them in parallel relationship, each strip having a body portion extending the length of the respective strip, the body portion having opposite surfaces which are complementary to and engage the outside surfaces of the two cylinders, and each strip having two flanges extending the length thereof, each flange projecting into one of said grooves and having a cross-sectional shape complementary to the respective groove, and screws connecting the two strips.

* * * * *